US008651308B1

(12) United States Patent
Sung

(10) Patent No.: US 8,651,308 B1
(45) Date of Patent: Feb. 18, 2014

(54) COSMETIC PACKAGE CONTAINER

(71) Applicant: Chia-Meng Sung, Taichung (TW)

(72) Inventor: Chia-Meng Sung, Taichung (TW)

( * ) Notice: Subject to any disclaimer, the term of this patent is extended or adjusted under 35 U.S.C. 154(b) by 0 days.

(21) Appl. No.: 13/633,137

(22) Filed: Oct. 2, 2012

(51) Int. Cl.
*B65D 6/00* (2006.01)
*A45D 40/00* (2006.01)

(52) U.S. Cl.
USPC ..... 220/4.25; 220/4.21; 220/4.24; 220/288; 206/581; 206/457; 401/88

(58) Field of Classification Search
USPC ..... 206/457, 581; 220/4.24–4.25, 288, 676; 401/88
See application file for complete search history.

(56) References Cited

U.S. PATENT DOCUMENTS

| | | | | | |
|---|---|---|---|---|---|
| 2,975,547 | A * | 3/1961 | Greve | 220/4.25 |
| 2,998,896 | A * | 9/1961 | Miller | 220/4.26 |
| 3,346,279 | A * | 10/1967 | Stachiw et al. | 220/4.25 |
| 5,025,817 | A * | 6/1991 | Wen | 206/581 |
| 5,064,073 | A * | 11/1991 | Folland | 220/521 |
| 5,526,966 | A * | 6/1996 | Lutzker | 222/480 |
| 5,792,496 | A * | 8/1998 | Fekete et al. | 426/104 |
| 6,050,438 | A * | 4/2000 | Kovens et al. | 220/4.24 |
| 6,099,872 | A * | 8/2000 | Whetstone, Jr. | 426/90 |
| 6,102,209 | A * | 8/2000 | D'Andrea | 206/581 |
| 6,193,427 | B1 * | 2/2001 | Benguigui | 401/88 |
| 6,311,860 | B1 * | 11/2001 | Reidinger et al. | 220/521 |
| 6,688,795 | B1 * | 2/2004 | Jacob et al. | 401/207 |
| D573,026 | S * | 7/2008 | Tsai | D9/519 |
| D644,939 | S * | 9/2011 | Teller | D9/726 |
| 2002/0008105 | A1 * | 1/2002 | Herbstreit et al. | 220/4.25 |
| 2002/0127046 | A1 * | 9/2002 | Gueret | 401/88 |
| 2003/0161675 | A1 * | 8/2003 | Lee | 401/200 |
| 2003/0201201 | A1 * | 10/2003 | Cheng | 206/457 |
| 2006/0201941 | A1 * | 9/2006 | Lee | 220/4.21 |
| 2006/0254945 | A1 * | 11/2006 | Green et al. | 206/457 |
| 2010/0101600 | A1 * | 4/2010 | Kang | 132/299 |
| 2011/0024316 | A1 * | 2/2011 | Ginsburg | 206/385 |
| 2011/0056866 | A1 * | 3/2011 | Thiebault | 206/581 |
| 2011/0135377 | A1 * | 6/2011 | Teller | 401/88 |

* cited by examiner

*Primary Examiner* — Mickey Yu
*Assistant Examiner* — Brijesh V. Patel
(74) *Attorney, Agent, or Firm* — Leong C. Lei

(57) ABSTRACT

The present invention is related to a cosmetic package container, in particular, to a three-piece assembly of a cosmetic package container in a hollow spherical shape, comprising a cap unit and a base unit respectively of a semi-spherical hollow shape assembled in a top-down manner together with as a central ring unit having a net structure and attached to an opening of the base unit. A paste of cosmetic material is filled into the container via a filling perforation at the bottom portion of the base unit. The outer surface of the central ring unit is provided with threads for parts of the container to be fastened with ease to form a complete assembly of the container. The cap and base units are of a double-layered structure formed of different materials such that the outer appearance of the container can be of various decorative designs and is practical to use.

2 Claims, 4 Drawing Sheets

COSMETIC PACKAGE CONTAINER

TECHNICAL FIELD OF THE INVENTION

The present invention is related to a cosmetic package container and, in particular, to a cosmetic package container of three-piece assembly filled with a paste of cosmetic material. The structural configuration of the cosmetic package container utilizes a central ring unit to allow a hollow cap unit to be assembled onto a base unit provided for filling of the cosmetic material, and the two units, being of a double-layer structure, are manufactured by injection molding to form a sphere that is appealing to the eye.

DESCRIPTION OF THE PRIOR ART

Common cosmetic package containers filled with a cosmetic material of paste type are mostly of the design of an elongated tubular shape such as a lipstick container, and these containers, being of elongated tubular shape, often use special curves to modify their appearance for bringing more aesthetic effects. Despite the fact that these designs introduce more or less variations to the appearances of the containers, they still fail to create a distinct appearance that is completely different from an elongated shape; in other words, such elongated shape of appearance of containers can still cause confusions to users having other containers such as eyelash paste, eye gel and eye pencil that are also of the design of elongated shapes, in their purses or bags, making it inconvenient to retrieve the desired cosmetic tool. In addition, these conventional containers cannot be assembled with ease but require skilled techniques or aids of special machinery for filling in order to complete the filling process of the manufacturing. As a result, the overall manufacturing cost is high and the filling process requires higher level of technology and technique, which are the main reasons causing conventional lipstick products to be of high production costs. In view of different consumer groups, lipsticks provided for lip protection purposes are of greater population in their applications and usages; therefore, there is a need to provide a lipstick with ease of use and with an effectively reduced manufacturing cost while having a novel appearance that is entertaining and vivid and having a design that is convenient to the practical uses, easy to carry, and suitable for all consumers. In other words, there is a need to provide an improved cosmetic package container and, in particular, an improved structural design to a conventional container for lipstick products.

SUMMARY OF THE INVENTION

To overcome the drawbacks of the conventional cosmetic containers filled with a paste of cosmetic material, including difficulties to the assembly thereof due to complicated components, appearances lacking distinction from other cosmetic products, higher production costs, and other practical inconvenience in applications and usages, the inventor seeks to provide an improved cosmetic package container based on years of research and development. The improved cosmetic package container of the present invention is of a novel spherical shape constituting the outer appearance thereof and is of a three-piece assembly such that the above-mentioned drawbacks of the conventional cosmetic containers can be overcome.

An objective of the present invention is to provide: a cosmetic package container of three-piece assembly filled with a paste of cosmetic material such that the overall structural configuration of the container is simplified, the manufacturing process is facilitated and the overall production cost is lowered. An opening for filling of the paste of the cosmetic material is predefined at the bottom portion of the container such that the paste of the cosmetic material can be supplied into and solidified to be supported on the support frame of the central ring unit and such that the filling of the container of the present invention is facilitated for safety and economic purposes in order to achieve the practical applications and usages thereof.

Another objective of the present invention is to provide a cosmetic package container comprising a cap unit and a base unit respectively formed of a semi-spherical hollow shape, wherein the two units are each constructed of a double-layer structure with inner and outer layers having different materials to form the semi-spherical hollow shapes. The outer appearance of the container of the present invention can therefore be of any decorative designs and special shapes while having a novel and overall spherical shape that is appealing to the eye and is also of practical convenience to the use, such as retrieval of the container, and easy carrying of the container. In addition, the container of the present invention can also be entirely made of recycling plastics such that it has the merit of being environmentally friendly.

DETAILED DESCRIPTION OF THE PREFERRED EMBODIMENTS

Figure 1:
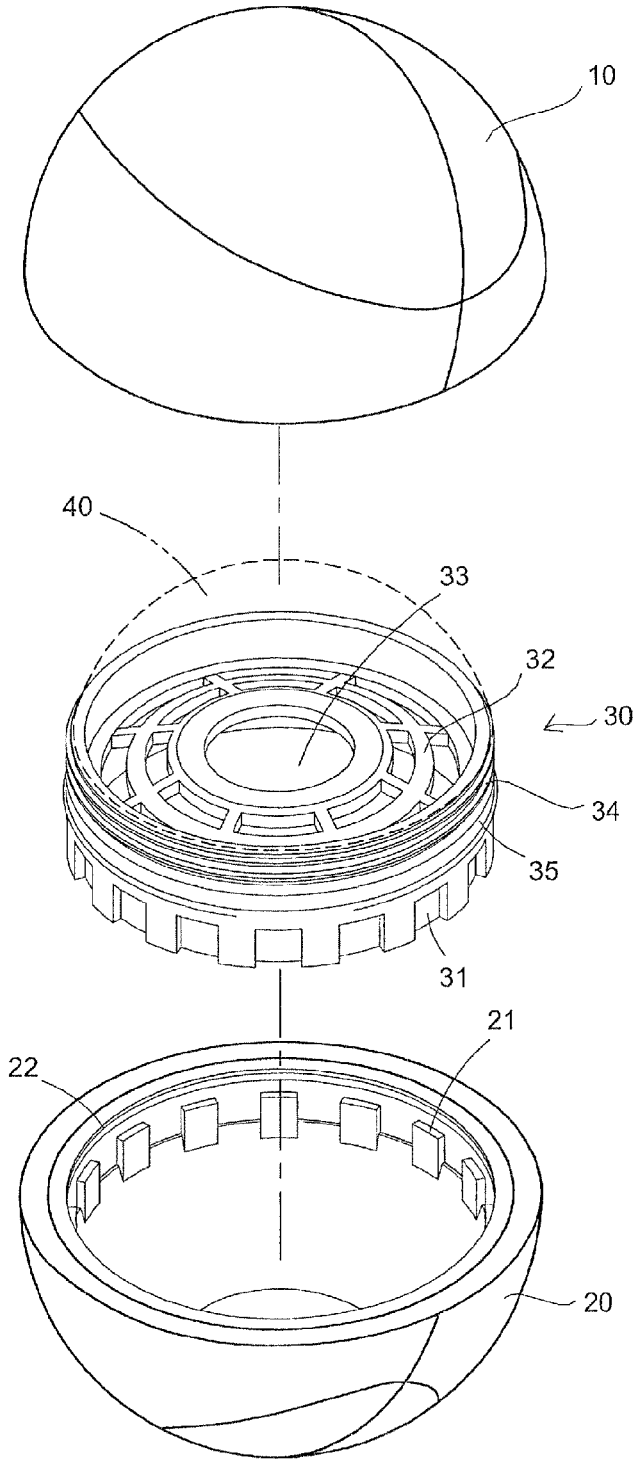
FIG. 1 is an exploded view of a cosmetic package container of the present invention.
Figure 2:
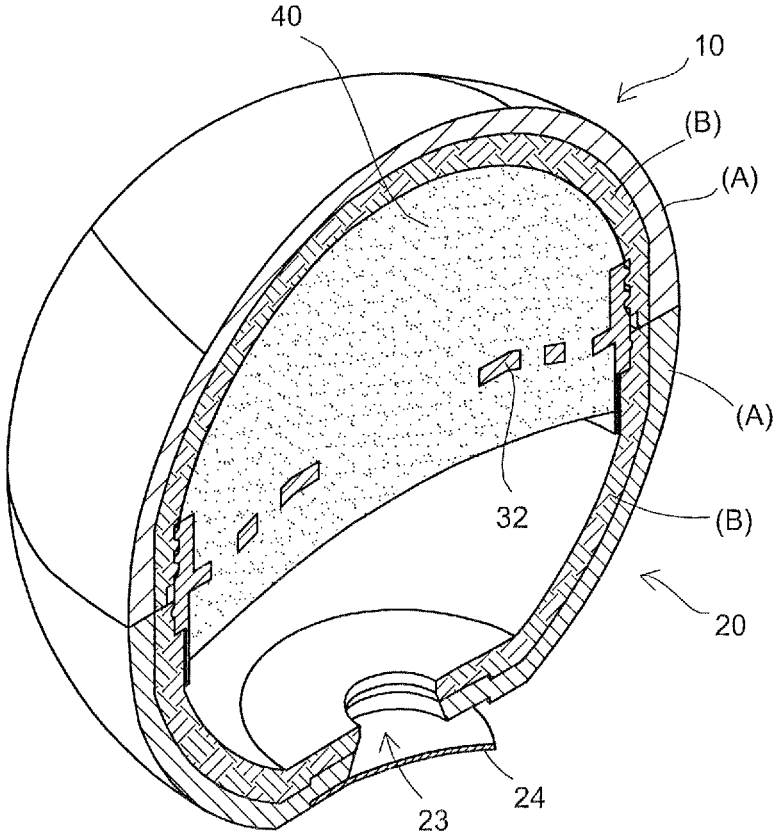
FIG. 2 is a perspective sectional view of a completely assembled cosmetic package container of the present invention.
Figure 3:
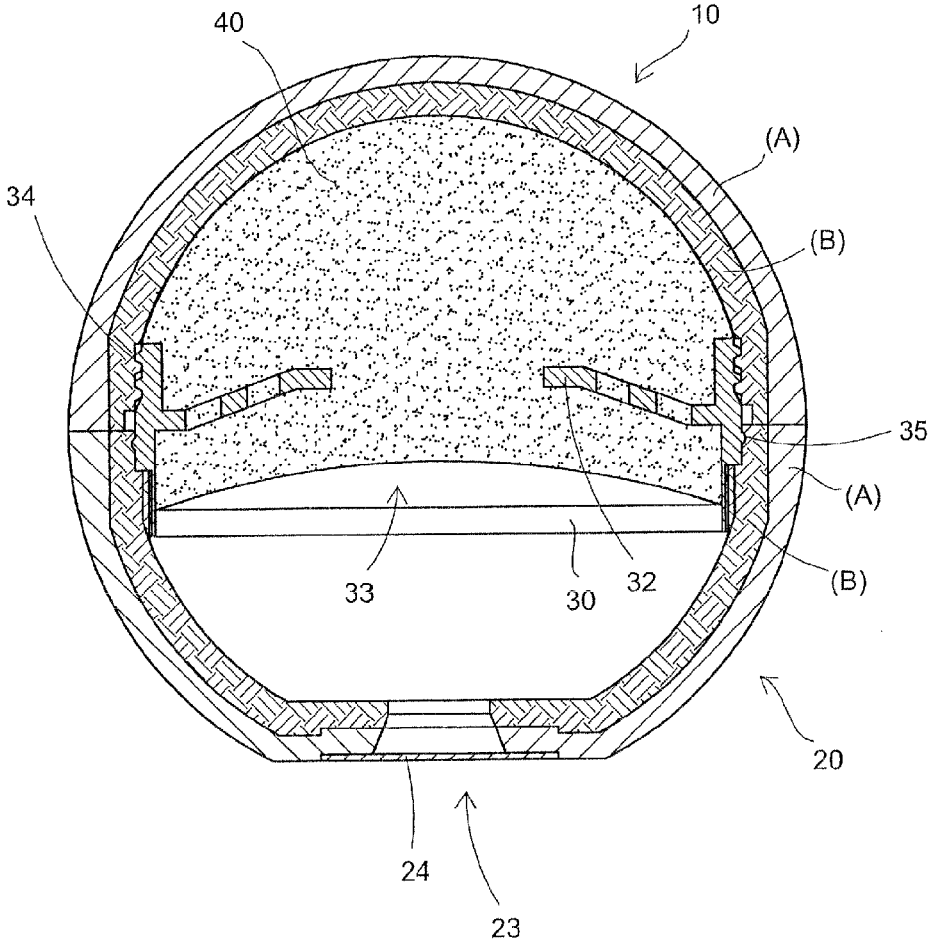
FIG. 3 is a sectional plan view of the completely assembled cosmetic package of the present invention.
Figure 4:
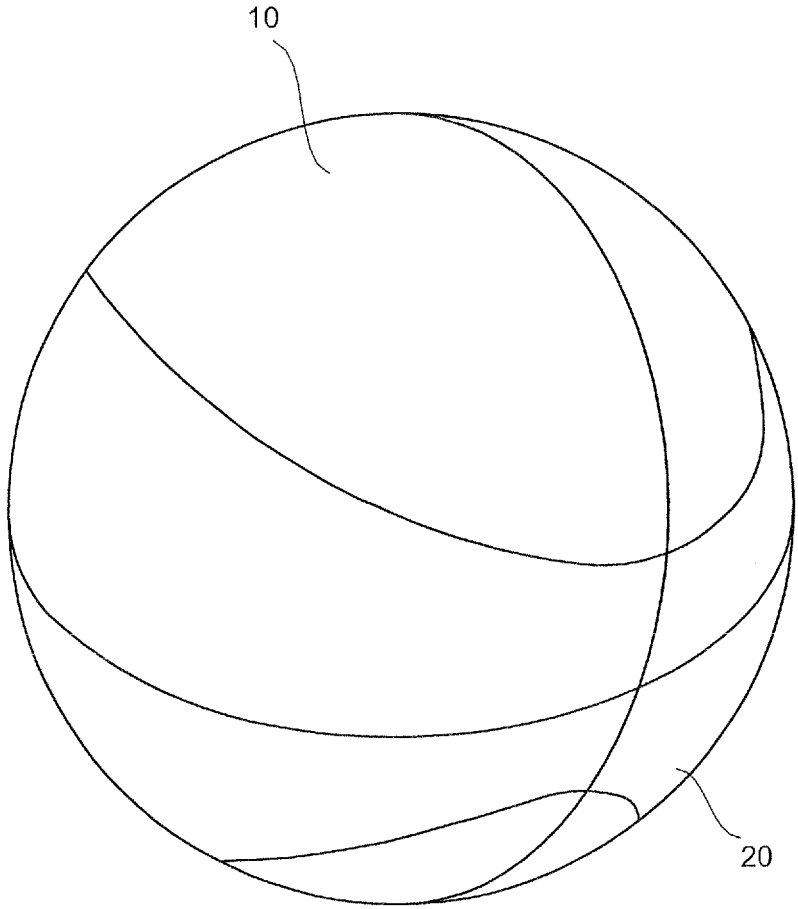
FIG. 4 is a perspective view showing an outer appearance of the completely assembled cosmetic package of the present invention.

The present invention relates to a cosmetic package container and, in particular, to an improved cosmetic package container with a novel structural configuration designed to facilitate the filling of a cosmetic material into the empty container. The cosmetic package container is of a generally spherical-shape constituting an outer appearance thereof and comprises a cap unit 10 and a base unit 20 that are both formed of semi-spherical hollow shapes corresponding to each other in addition to a central ring unit 30 being fixed to a top of the base unit 20, forming a cosmetic package container of three-piece assembly. The cap unit 10 and the base unit 20 are each constructed of two layers of different materials. Fore example, the outer layers can be made of rubber material with elasticity, whereas the inner layers can be made of hard plastic material. Furthermore, the outer layers can be provided with various decorative patterns to allow the cosmetic container to have an appearance of a ball, such as a soccer, basketball, baseball, or tennis ball. Therefore, the outer appearance of the cosmetic package container of the present invention is distinct from the ones of conventional cosmetic containers while having a novel decoratively designed outer appearance with variations in terms of the overall design of the container as a whole. A shown in FIGS. 1~4, the cosmetic package container of the present invention comprises the cap unit 10 having a semi-spherical hollow shape and the base unit 20 also having a semi-spherical hollow shape. In addition, the cap unit 10 and the base unit 20 are formed, during a production process thereof, to be of a double-layered structure comprising an inner layer (B) and an outer layer (A); wherein the inner layer (B is formed of a hard plastic material with a polished surface and the outer surface (A) is formed of a rubber material with a softness and an elasticity, and the outer appearance of the container is dependent on the decorative pattern of the mold that makes the outer layers and the color of the material used by the mold, wherein the container can be molded into a shape of a ball, such as a soccer, basketball, baseball, or tennis ball. The central ring unit 30 is provided with a support frame 32 at a center thereof, wherein the support frame 32 is formed with multiple concentric ribs and defines a central through-hole 33 at its center. The base unit 20 is assembled onto the cap unit 10 through the central ring unit 30 and provided for filling of a cosmetic material therein. The central ring unit 30 is provided with a threaded portion 34 and an annular protrusion 35 at an outer surface thereof, wherein the annular protrusion 35 is located below the threaded portion 34. Furthermore, the central ring unit 30 defines at the outer surface thereof a plurality of recesses 31 that extend in parallel from a bottom edge of the outer surface towards the annular protrusion 35 and are consecutively arranged along the bottom edge of the outer surface to form a ring of parallel recesses. The cap unit 10 is provided with a threaded portion, corresponding to the threaded portion 34 of the central ring unit 30, at an inner surface thereof. The base unit 20 defines an opening 23 at a bottom thereof for filling a cosmetic material therein and defines an annular groove 22, corresponding to the annular protrusion 35 of the central ring unit 30, at an inner surface thereof. The base unit 20 is provided with a plurality of protrusions 21, corresponding to the recesses 31 of the central ring unit 30, at the inner surface thereof, wherein the protrusion 21 is evenly distributed and located below the annular groove 22. In assembling the container of the present invention, the protrusions 21 of the base unit 20 is inserted from the bottom edge of the outer surface of the central ring unit 30 to engage with the recesses 31 of the central ring unit 30, and the annular groove 22 of the base unit 20 is engaged with the annular protrusion 35 of the central ring unit 30, so that the base unit 20 can be fixed to the central ring unit 30 properly. This feature can facilitate connecting the cap unit 10 with the central ring unit 30 or disconnecting the cap unit 10 from the central ring unit 30. The cap unit 10 can be releasably mounted to the central ring unit 30 via the threaded portions of the cap unit 10 and the central ring unit 30, thereby forming a container that can store a cosmetic material 40 being supplied through the opening 23 and supported onto the support frame 32 of the central ring unit 30.

The bottom portion of the base unit 20 is preferably provided with a flattened or slightly concaved inward platform surface such that the cosmetic package container of the present invention can be placed on a spot or surface stably. The central bottom portion of the base unit 20 is defined with the opening 23 for filling of a cosmetic material 40 in a paste form therein. During the filling process, a filling pipe can be inserted at a certain depth from the bottom of the base unit 20 and therein such that spilling or overshooting of the filling to the outer side thereof, causing contamination or damages to the container, can be prevented. The filling is also accomplished along with the central ring unit 30 provided on a central section of the container such that the support frame 32 arranged at the center provides skeleton-type of positioning aids to the paste filling therein, allowing the paste of the cosmetic material 40 to be solidified and hold onto suitable positions on the upper and lower sides of the support frame 32. As such, the support frame 32, provided at the central ring unit 30, can support the solidified paste of the cosmetic material 40 properly, so that the paste can be affixed to the container properly. In addition, after the filling of the paste of the cosmetic material, the opening 23 on the bottom portion of the base unit 20 can be sealed by a sealing sheet, such as a sticker 24; wherein the sealing sheet can be an independently designed piece as long as it serves the purpose of sealing the opening 23 properly and such that the cosmetic package container filled with the paste of cosmetic material is safe and can be conveniently operated by users. The cosmetic package container of the present invention is of a three-piece assembly utilizing a double-layered structure constructed of different materials for great visual presentation and design such that the cosmetic package container filled with cosmetic material is appealing to the eye and is practical to the operation and uses thereof.

The major improvement of the overall cosmetic package container of the present invention includes: the cap unit 10 and the base unit 20 for filling are of semi-spherical hollow shapes and are made of a double-layered structure having the inner and outer layers constructed with different materials (A, B), forming an outer appearance thereof with decorative patterns and designs in addition to a soft and elastic surface; at the inner portion of the assembled hollow sphere, a central ring unit 30 is attached to the top of the base unit 20 to form the assembly with the cap unit 10 such that the structural components required for the container, including the cap unit 10, the base unit 20, and the central ring unit 30, are simplified and assembly steps for the container are not involved with high-level skilled techniques; furthermore, as the double-layered structure with inner and outer layers are formed of different materials, the overall appearance can be made of various spherical shapes with decorations, making the container of the present invention distinct from other cosmetic tools or containers for easy retrieval and uses; also, with the aids provided by the support frame 32 of the central ring unit and with the configuration of the predefined opening 23 at the bottom portion of the base unit 20, the filling of the cosmetic material 40 can be performed more easily and reliably, and the paste of the cosmetic material 40 can be affixed to the container more securely to achieve an industrial standardization of manufacturing; in addition, by sealing the opening 23 with a sealing sheet, such as a sticker 24, at the bottom portion thereof, the cosmetic package container is made safe and appealing to the eye as a whole; furthermore, the retrieval of the cosmetic container is convenient to the user during its uses and the overall structure of the container can be manufactured with ease and the overall appearance is enclosed by different soft and comfortable material in order to form different spherical shapes with various designs and to achieve the anti-shock packaging; in particular, the cosmetic material filling in the container can be a paste form of cosmetic material, making the container of the present invention filled with such cosmetic material easily identified by users among other cosmetic tools or containers. The structural configuration and design of the cosmetic package container of the present invention is novel and contains improved effects over conventional containers in similar categories of cosmetic containers.

In view of the above, the cosmetic package container of the present invention comprises the cap unit and the base unit of the semi-spherical hollow shape respectively assembled together as well as the central ring unit provided for securement thereof such that the filling of the cosmetic material therein is safe and convenient. The inner and outer layers of the cap unit and the base unit are of different materials to form a double-layered structure such that the outer appearance of the assembled container is appealing to the eye with decorations. The overall structural configuration and filling operation required for the cosmetic package container of the present invention are simplified such that the production cost is lowered, the assembly is facilitated, the packaging is distinct and the outer appearance of the container product can be modified to be of various different designs with practical applications.

What is claimed is:

1. A cosmetic package container, comprising a cap unit, a central ring unit provided with a support frame at a center thereof, and a base unit assembled onto said cap unit through said central ring unit and provided for filling of a cosmetic material therein, characterized in that: said cap unit and said base unit are respectively of a semi-spherical hollow shape arranged opposite to each other; wherein said central ring unit is provided with a threaded portion and an annular protrusion at an outer surface thereof, the annular protrusion being located below the threaded portion, said central ring unit defines at the outer surface thereof a plurality of recesses that extend in parallel from a bottom edge of the outer surface towards the annular protrusion and are consecutively arranged along the bottom edge of the outer surface to form a ring of parallel recesses, said cap unit is provided with a threaded portion, corresponding to the threaded portion of said central ring unit, at an inner surface thereof, said base unit defines an opening at a bottom thereof for filling a cosmetic material therein and defines an annular groove, corresponding to the annular protrusion of said central ring unit, at an inner surface thereof, said base unit is provided with a plurality of protrusions, corresponding to the recesses of said central ring unit, at the inner surface thereof and below the annular groove, the protrusions of said base unit is inserted from the bottom edge of the outer surface of said central ring unit to engage with the recesses of said central ring unit and the annular groove of said base unit is engaged with the annular protrusion of said central ring unit, whereas said cap unit is releasably mounted to said central ring unit via the threaded portions of said cap unit and said central ring unit, thereby forming a container that can store a cosmetic material being supplied through the opening of said base unit and supported onto the support frame of said central ring unit.

2. The cosmetic package container according to claim 1, wherein the opening of said base unit can be sealed by a sealing sheet.

* * * * *